US010427174B2

(12) United States Patent
Gong et al.

(10) Patent No.: US 10,427,174 B2
(45) Date of Patent: Oct. 1, 2019

(54) SWITCHABLE SHOWERHEAD

(71) Applicant: BESTTER(XIAMEN) TECHNOLOGY INC., Xiamen (CN)

(72) Inventors: Binhua Gong, Xiamen (CN); Jianbo He, Xiamen (CN); Mengshi Guo, Xiamen (CN); Chaojian Lin, Xiamen (CN)

(73) Assignee: BESTTER(XIAMEN) TECHNOLOGY INC., Xiamen (CN)

( * ) Notice: Subject to any disclaimer, the term of this patent is extended or adjusted under 35 U.S.C. 154(b) by 23 days.

(21) Appl. No.: 15/268,009

(22) Filed: Sep. 16, 2016

(65) Prior Publication Data

US 2017/0100728 A1 Apr. 13, 2017

(30) Foreign Application Priority Data

Oct. 9, 2015 (CN) ..... 2015 1 0647828

(51) Int. Cl.

*B05B 15/62* (2018.01)
*B05B 1/16* (2006.01)
*B05B 1/18* (2006.01)
*B05B 12/00* (2018.01)

(52) U.S. Cl.

CPC ..... *B05B 1/1681* (2013.01); *B05B 1/1636* (2013.01); *B05B 1/18* (2013.01); *B05B 12/002* (2013.01); *B05B 12/0024* (2018.08); *B05B 15/62* (2018.02)

(58) Field of Classification Search

CPC ..... B05B 1/1681; B05B 1/1636; B05B 1/18; B05B 12/002
USPC ..... 239/443
See application file for complete search history.

(56) References Cited

U.S. PATENT DOCUMENTS 3,568,716 A * 3/1971 Heitzman ..... B05B 1/1636 137/599.08
3,998,390 A * 12/1976 Peterson ..... B05B 1/083 239/394
4,043,511 A * 8/1977 Nakamura ..... B05B 1/083 239/394
4,068,801 A * 1/1978 Leutheuser ..... B05B 1/1645 239/381

(Continued)

FOREIGN PATENT DOCUMENTS

EP 1577016 * 3/2004 ..... B05B 1/16

*Primary Examiner* — Chee-Chong Lee
(74) *Attorney, Agent, or Firm* — Rabin & Berdo, P.C.

(57) ABSTRACT

A switchable shower head includes a waterway device providing at least two water flow outlet functions; and a waterway switching device including a water diversion plate rotatable to switch between outlet functions; a fixing seat disposed above the water diversion plate; a ratchet wheel coaxially connected to and synchronously rotatable with the water diversion plate via the fixing seat and including a ratchet; a transmission element that abuts against the ratchet to cause the ratchet wheel to rotate; a transmission rack that has the transmission element slidably assembled thereto to slide in a sliding direction, that is movable with respect to the ratchet wheel in a moving direction, and that is resettable by two or more elastic elements; and a driving device that comprises a press button in communication with the fixing seat and a driver mechanism provided between the press button and the transmission rack.

10 Claims, 10 Drawing Sheets

(56) References Cited

U.S. PATENT DOCUMENTS

| | | | | |
|---|---|---|---|---|
| 5,215,258 | A * | 6/1993 | Jursich | B05B 1/1636 239/394 |
| 6,622,945 | B1 * | 9/2003 | Wu | B05B 1/1654 239/443 |
| 2012/0261488 | A1 * | 10/2012 | Cheng | B05B 1/1609 239/224 |
| 2013/0015269 | A1 * | 1/2013 | Zhou | B05B 1/1636 239/437 |

* cited by examiner

SWITCHABLE SHOWERHEAD

FIELD OF THE INVENTION

The present invention relates to sanitary wares, especially to a shower head with a plurality of switchable outlet functions.

BACKGROUND OF THE INVENTION

Existing shower heads in the market mostly apply with a switch dial button to switch the outlet functions to achieve varies outlet functions such as massage water, rotating water, etc, but the switch device is unstable, and it has short service time. The switch dial button is usually disposed at the joint portion of the handle and the main body, when used, the dial button is dialed to switch the outlet functions. However, this kind of switch method has disadvantage, if the switch position is close, a person can use a single hand to dial, but if it is far away, a person must use both hands to use, it is not convenient enough to operate.

SUMMARY OF THE INVENTION

The present invention is provided with a switchable shower head to solve the existing problem.

The technical proposal of the present invention is that:

A switchable shower head, comprises a waterway device and a waterway switch device, the waterway device comprises at least two outlet functions, wherein the waterway switch device comprises:

a water diversion plate disposed in the waterway, when rotating the water diversion plate, the outlet is switched to different outlet functions;

a ratchet wheel, which is coaxially connected to the water diversion plate;

a transmission rack, which is disposed to the waterway device and is capable of moving away and closing to the ratchet wheel, the transmission rack is reset by two or more than two elastic elements;

a transmission element, which is slidably assembled to the transmission rack and is capable of abutting against the ratchet of the ratchet wheel to move the ratchet wheel to rotate, an angle is formed between the sliding direction of the transmission element and the sliding direction of the transmission rack.

And a driving mechanism is further provided, the driving mechanism comprises a press button and a driving means assembled between the press button and the transmission rack.

In another preferred embodiment of the present invention, the transmission rack is limited by a sliding limit mechanism to slide forth and block in one direction.

In another preferred embodiment, the angle between the moving direction of the transmission rack and the sliding direction of the transmission element is 30~150 degrees. Preferred 90 degrees.

In another preferred embodiment, the central portion of the transmission rack is disposed with a sliding cavity and a fixing shaft, the transmission element is sleeved on the fixing shaft, a third reset spring is disposed between the transmission element and the side wall of the sliding cavity, the transmission element compresses the third reset spring when sliding to abut against the ratchet wheel.

In another preferred embodiment, the left and right end of the transmission rack is disposed with a transmission rack first reset spring and a second reset spring.

In another preferred embodiment, the waterway device further comprises a reset rack, the reset rack is fixed to the waterway device to correspond to the transmission rack, a spring flapper is further configured, the left and right end of the transmission rack is respectively disposed with a first reset spring and a second reset spring, one end of the first reset spring and the second reset spring is disposed to the transmission rack, the other end is disposed to the spring flapper.

In another preferred embodiment, the waterway device comprises a cover plate component, one side of the cover plate component is disposed with a plurality of inlet holes, the other side is disposed with a plurality of outlet holes, different inlet hole or different combination of the inlet holes corresponds to different set of outlet holes to form different outlet function; when the water diversion plate rotates, the outlet holes of the water diversion plate correspond to the inlet hole or the combination of the inlet holes of the cover plate component.

In another preferred embodiment, a fixing seat is disposed at the upper portion of the cover plate component, the fixing seat comprises a main body, an extending section and a rear section, the bottom portion of the extending section is disposed with a pendulum fixing column, the extending section is disposed with an elongated through hole in the left-right direction, the left end of the elongated through hole is disposed with an elongated guide groove to the left; a button fixing column is disposed at the transition area of the extending section and the rear section.

In another preferred embodiment, the transmission element comprises a pendulum and a sliding block, one end of the pendulum is pivoted to the pendulum fixing column at the bottom portion of the fixing seat, the other end is a free end passing through the elongated through hole, one side of the free end abuts against the side of the sliding block; one end of the press button is fixed to the button fixing column at the bottom portion of the fixing seat, the other end abuts against the other side of the free end of the pendulum.

As can be seen from above, the present invention has advantages as follows:

1. The present invention is applied with a driving mechanism to rotate the ratchet wheel, pressing the press button can achieve the switch, a person can use one hand to operate, it is convenient to use.

2. The driving mechanism comprises the transmission rack and the transmission element, both are slidably coupled to drive the ratchet to rotate, it is applied with a reset spring to reset, this structure has long service life.

3. The transmission element comprises the pendulum and the sliding block, making it with small size and simple structure.

Figure 1:
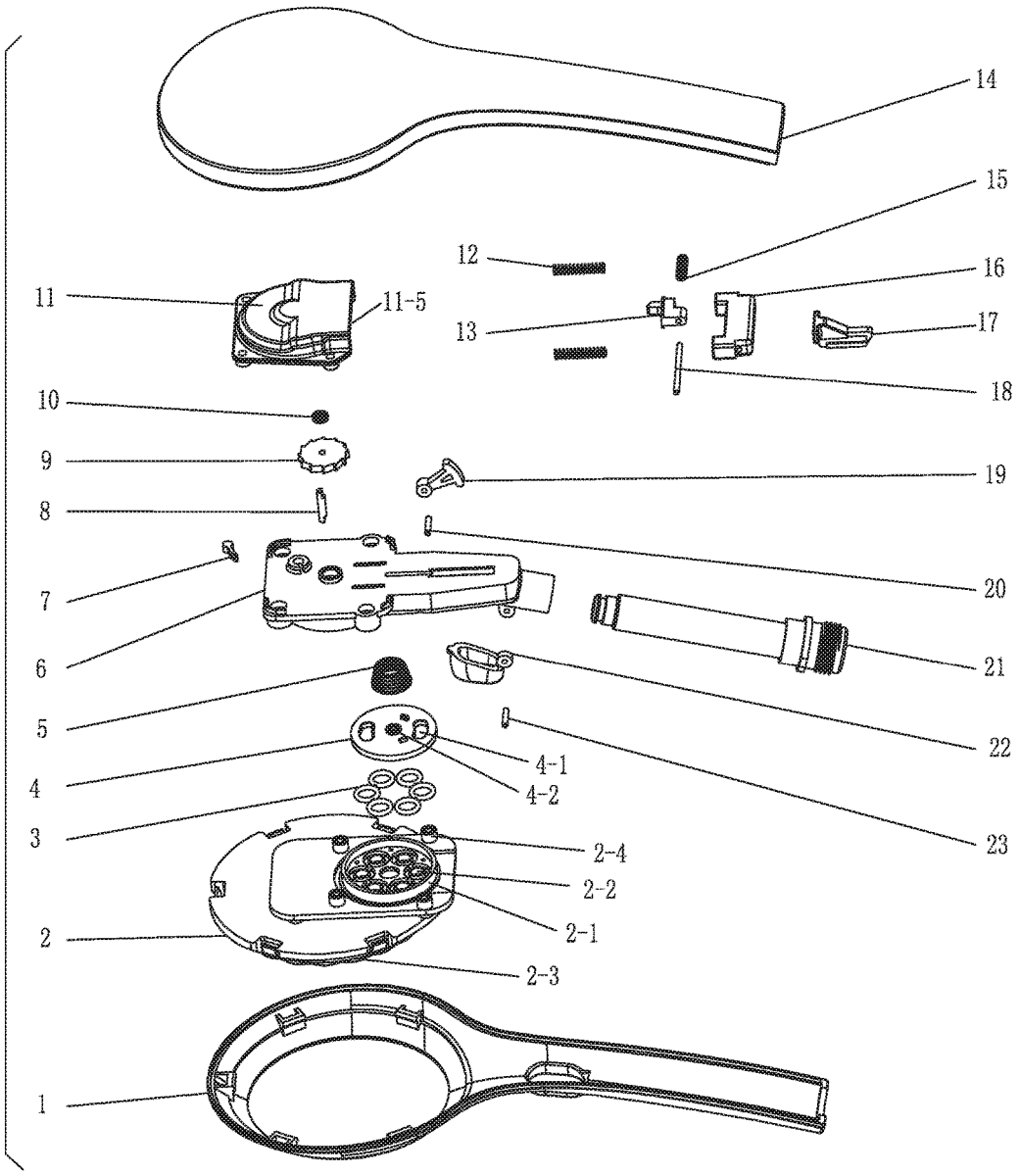
FIG. 1 illustrates an exploded and schematic diagram of the pressing switch shower head of the first embodiment.

REFERENCE SIGNS lower body 1, cover plate component 2, inlet ring 2-1, inlet hole 2-2, outlet hole 2-3, screw fixing column 2-4, special-shaped ring 3, water diversion plate 4, water diversion hole 4-1, water diversion plate shaft hole 4-2, taper spring 5, fixing seat 6, main body 6-1, extension section 6-2, rear section 6-3, screw hole 6-4, central through hole 6-5, stop pawl fixing seat 6-6, sliding strip 6-7, elongated through hole 6-8, guide groove 6-9, press button fixing column 6-10, press button fixing shaft hole 6-11, pendulum fixing column 6-12, outlet chamber 6-13, stop pawl 7, synchronous shaft 8, ratchet wheel 9, Y-shaped ring 10, reset rack 11, first and second reset spring A 12, transmission element 13, upper body 14, third reset spring B 15, transmission rack 16, sliding chamber 16-1, transmission element fixing shaft hole 16-2, spring fixing column 16-3, spring chamber 16-4, sliding block 17, transmission element fixing shaft 18, pendulum 19, pendulum fixing shaft 20, shaft 21, press button 22, press button fixing shaft 23.

DETAILED DESCRIPTION OF THE EMBODIMENTS

The first embodiment of the present invention, referring to FIGS. 1-9, is a press button switch shower head, which comprises a waterway device and a waterway switch device.

Referring to FIG. 1, the waterway device comprises a lower body 1 and an upper body 14. The upper and the lower body are respectively disposed with an upper handle and a lower handle, a shaft 21 having inlet function is disposed between the upper handle and the lower handle.

A cover plate component 2 is embedded in the main body of the lower body 1, the rear side of the cover plate component 2 is disposed with an inlet ring 2-1, the inlet ring 2-1 is disposed with a plurality of inlet holes 2-2 annularly arranged, each inlet hole 2-2 is disposed with a special-shaped ring 3 for sealing, the sealing rings 3 are fixedly connected to form an annular structure; the front side of the cover plate component 2 is disposed with a plurality of outlet holes 2-3, which are divided into different outlet function sets, different inlet hole 2-2 (of a different combination of the inlet holes) corresponds to a different set of outlet holes 2-3 so as to forma different outlet function. There are 2~4 outlet functions as needed, or more than 4.

A water diversion plate 4 is disposed in the inlet ring 2-1 above the inlet holes 2-2, a pair of water diversion holes 4-1 are disposed at the water diversion plate symmetrically. When the water diversion plate rotates, the water diversion holes 4-1 are corresponding to different inlet holes 2-2 or the combination to switch the outlet functions. The center of the water diversion plate 4 is disposed with a non-circle plate shaft hole 4-2, in this embodiment, the section of which is semi-circle, to rotate the water diversion plate 4. Other shapes are available in other embodiments, such as triangle, rectangle and other non-circle shape.

A fixing seat 6 is disposed above the water diversion plate, a taper spring 5 is disposed between the fixing seat 6 and the water diversion plate 4, the taper spring 5 is used to press the water diversion plate and to provide preload compensation to the sealing ring when in low water pressure.

Figure 4:
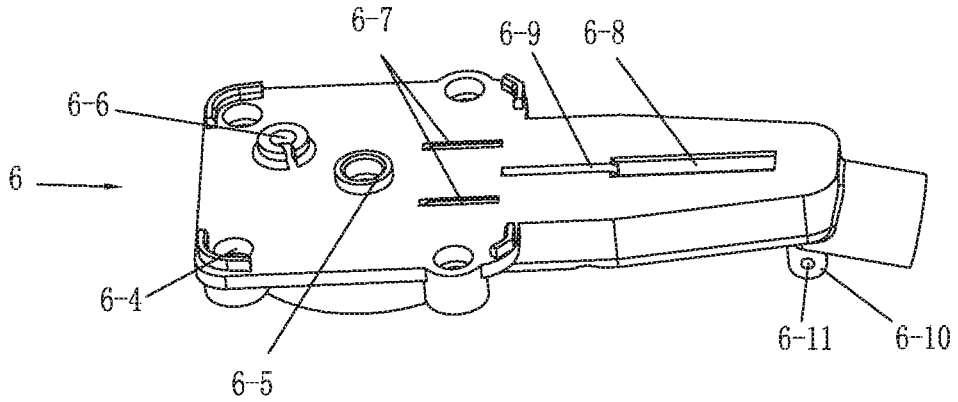
FIG. 4 illustrates a schematic diagram of the fixing seat of the first embodiment.
Figure 5:
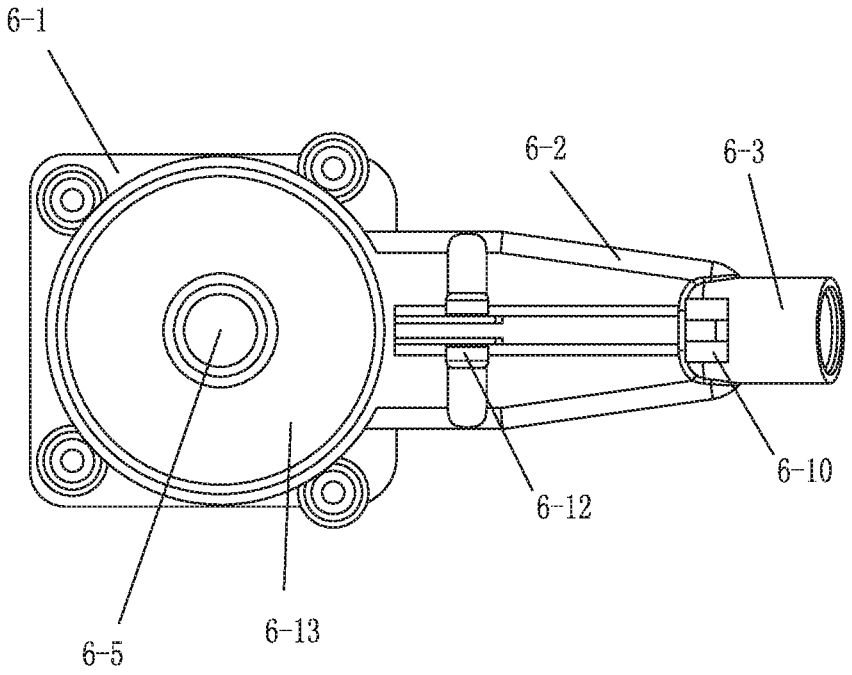
FIG. 5 illustrates a bottom view of the fixing seat of the first embodiment.

Referring to FIG. 4, the fixing seat 6 comprises a main body 6-1, an extending section 6-2 and a rear section 6-3 from left to right, the right end of the rear section 6-3 is disposed with an inlet, which is connected to the outlet of the shaft 21. The bottom of the main body 6-1 is disposed with an outlet chamber 6-13. Four corners of the main body 6-1 are respectively disposed with a screw hole 6-4, the center of the main body 6-1 is disposed with a central through hole 6-5, on the upper surface of the main body 6-1, a stop pawl fixing seat 6-6 is disposed between the central through hole 6-5 and the screw hole 6-4 at the left upper corner. Two left-right sliding strips 6-7 are disposed parallel between the right upper and the right lower screw holes 6-4. The bottom portion of the extending section 6-2 is disposed with a pendulum fixing column 6-12, which is disposed with a pendulum fixing shaft hole. A left-right elongated through hole 6-8 is disposed in the extending section 6-2, the left end of the elongated through hole 6-8 is disposed with an elongated guide groove 6-9. the transition area of the extending section 6-2 and the rear section 6-3 is disposed with a press button fixing column 6-10, which is disposed with a press button fixing shaft hole 6-11.

The waterway switch device comprises a ratchet wheel 9, the water diversion plate, a transmission mechanism and a driving mechanism, the water diversion plate has been described above. The ratchet wheel 9 is assembled to the center of the upper surface of the fixing seat 6, a synchronous shaft 8 is disposed between the ratchet wheel 9 and the water diversion plate 4, so that the ratchet wheel 9 and the water diversion plate 4 rotate synchronously. Two ends of the synchronous shaft 8 are non-circle shape that they are respectively inserted to the non-circle shaft hole of the ratchet wheel 9 and the water diversion plate 4.

Figure 6:
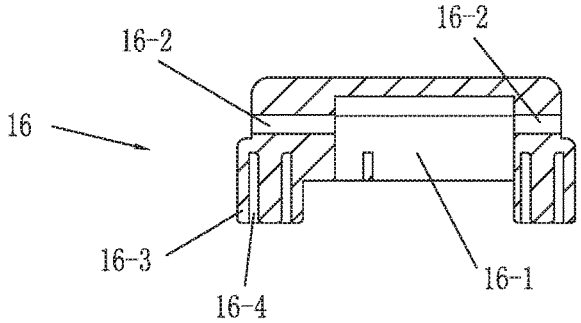
FIG. 6 illustrates a sectional diagram of the transmission rack of the first embodiment.

Referring to FIG. 6, the transmission mechanism comprises a transmission element 13 and a transmission rack 16, the later one is generally cuboid, the central portion of the transmission rack 16 is concaved inwardly with a sliding chamber 16-1, the left and right side of the sliding chamber 16-1 are respectively disposed with a transmission element fixing hole 16-2, the transmission element 13 is assembled to the sliding chamber 16-1 by the transmission element fixing shaft 18. the left and right end of the transmission rack 16 are respectively protruding to one side with a spring fixing column 16-3, which is disposed inside with a spring chamber 16-4 and a first and a second reset spring 12.

Figure 7:
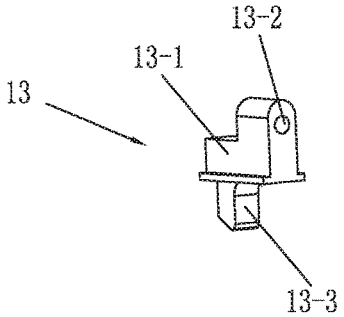
FIG. 7 illustrates a schematic diagram of the transmission element of the first embodiment.
Figure 8:
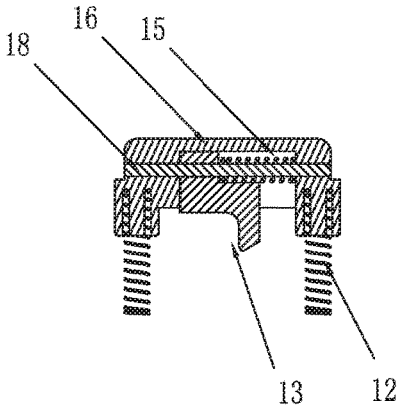
FIG. 8 illustrates a sectional diagram of the combination of the transmission rack and the transmission element of the first embodiment.

Referring to FIG. 7, the transmission element 13 comprises a pivot portion 13-1 and a transmission portion 13-3, the pivot portion 13-1 is disposed with a shaft hole 13-2. The transmission element 13 is fixed into the sliding chamber 16-1 of the transmission rack 16 by the transmission element fixing shaft 18, the transmission element 13 can slide left and right along the transmission element fixing shaft 18 in the sliding chamber 16-1. A third reset spring 15 is sleeved on the transmission element fixing shaft 18 between the transmission element 13 and the inner side wall of the transmission rack.

Figure 9:
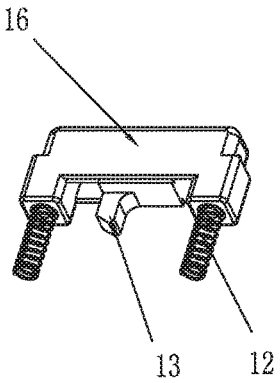
FIG. 9 illustrates a schematic diagram of the combination of the transmission rack and the transmission element of the first embodiment.
Figure 10:
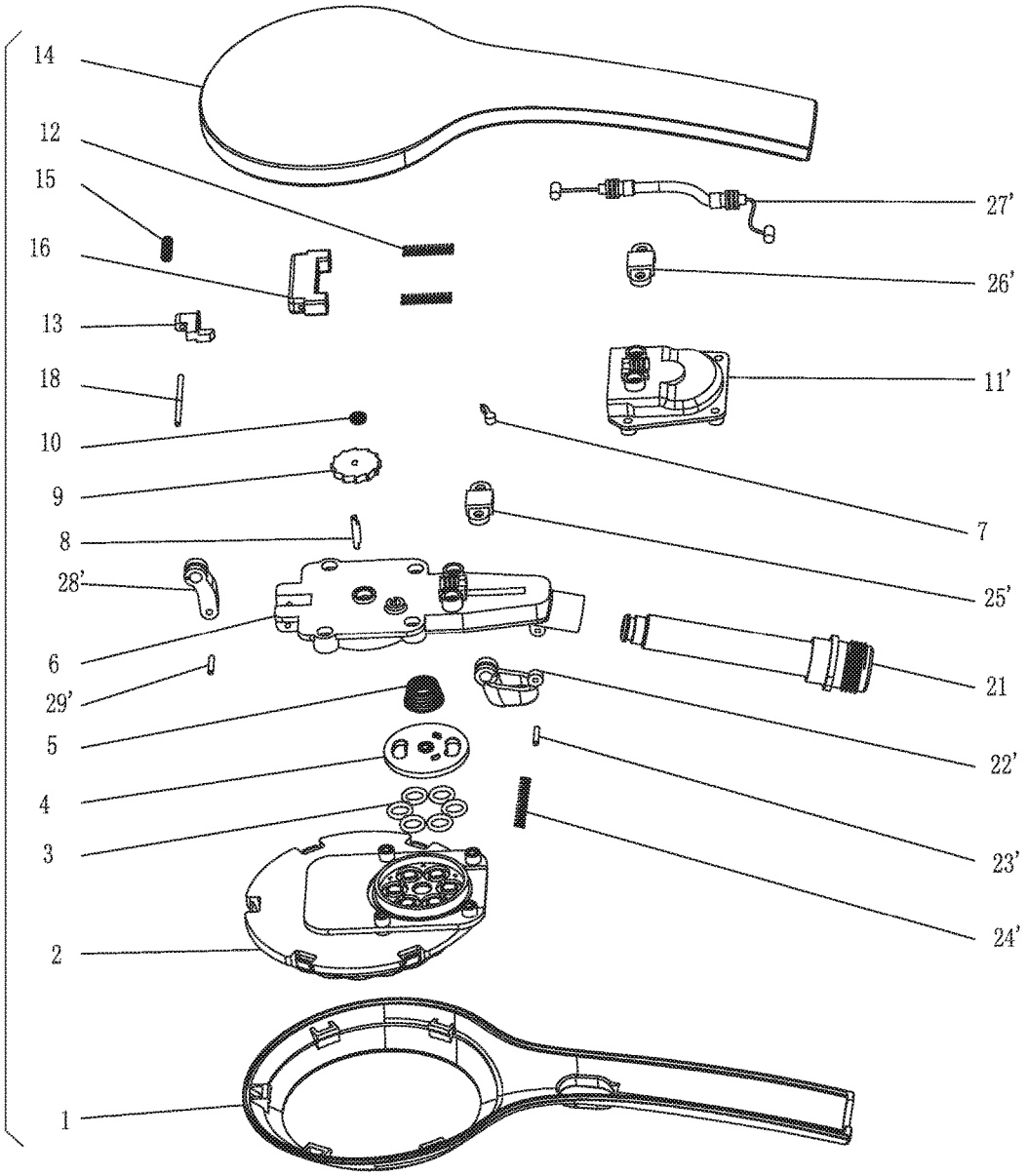
FIG. 10 illustrates an exploded and schematic diagram of the press button switch shower head of the second embodiment.

Referring to FIG. 9, the driving mechanism comprises a press button 22, a pendulum 19 and a sliding block 17, the sliding block 17 is assembled to the guide groove 6-9 to slide along the guide groove 6-9 and limited. One end of the pendulum is pivoted to the pendulum fixing column 6-12 at the bottom of the fixing seat, the other end is a free end passing through the elongated through hole 6-8, one side surface of the free end abuts against the side surface of the sliding block 17; one end of the press button 22 is fixed to the press button fixing column 6-10 at the bottom of the fixing seat, the other end abuts against the other side surface of the free end of the pendulum.

Figure 2A:
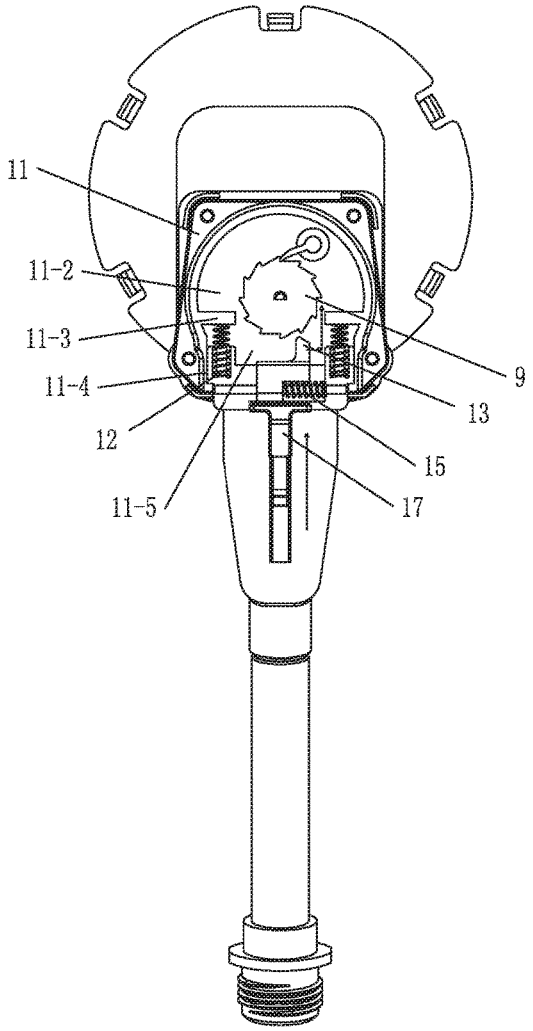
FIG. 2A illustrates a sectional diagram of the first embodiment before the switch.
Figure 2B:
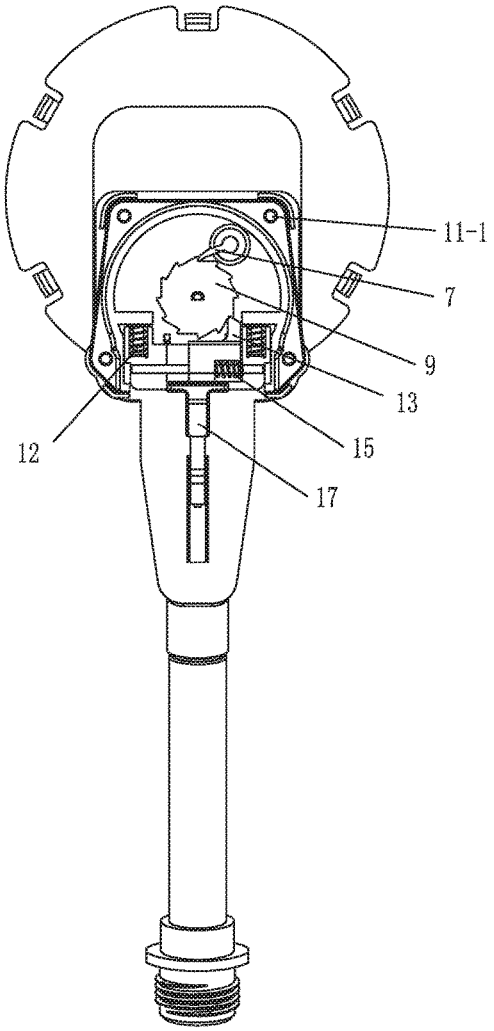
FIG. 2B illustrates a sectional diagram of the first embodiment after the switch.
Figure 3A:
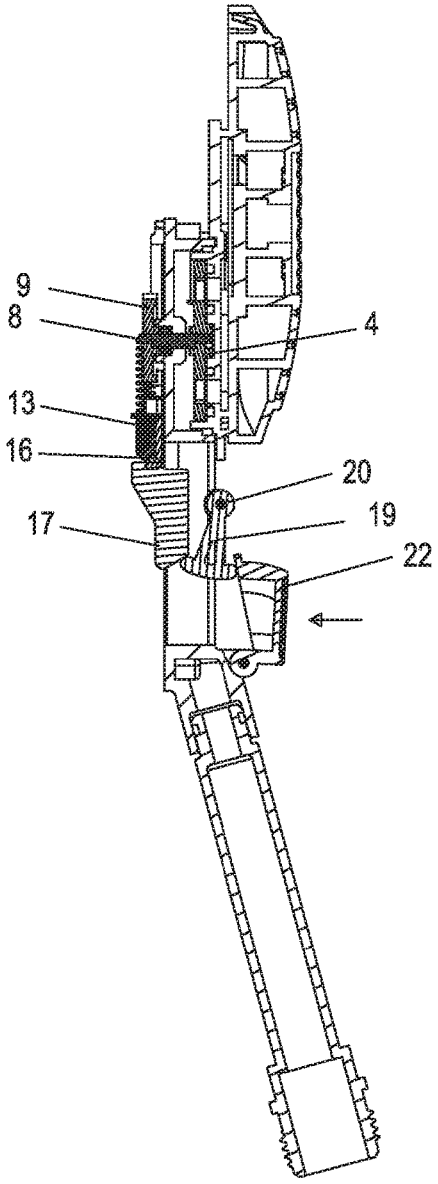
FIG. 3A illustrates a sectional diagram of the first embodiment from another view angle before the pressing.
Figure 3B:
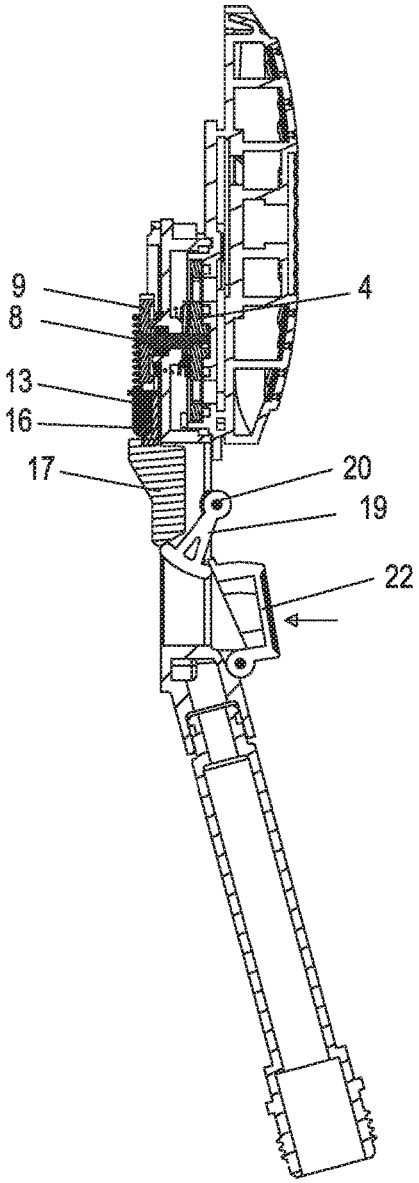
FIG. 3B illustrates a sectional diagram of the first embodiment from another view angle after the pressing.

Referring to FIG. 2A and FIG. 2B, the waterway switch device further comprises a reset rack 11, which is generally rectangle, four corners are respectively disposed with screw hole 11-1 corresponding to the screw hole 6-4 of the fixing seat 6, the bottom portion is disposed with a receiving chamber 11-2, the lower side of the receiving chamber 11-2 is disposed with an opening 11-5, the left and right side of the central portion are disposed with a spring flapper 11-3, the lower portion of the spring flapper 11-3 is disposed with a limit portion 11-4, the transmission rack 16 enters the opening 11-5 and slides up and down along the limit portion 11-4.

The present invention is used as described hereafter, referring to FIG. 2A, FIG. 2B and FIG. 3A, FIG. 3B:

Pressing the press button 22 to make the press button 22 rotate about the button fixing shaft 23 in the press button fixing shaft hole 6-11, the free end of the button 22 pushes the free end of the pendulum; the free end of the pendulum 19 rotates about the pendulum fixing shaft 20 in the pendulum fixing column 6-12 to push the sliding block 17 to slide up along the guide groove 6-9;

The sliding block 17 pushes the transmission rack 16 to move up, so that the end of the transmission element 13 in the transmission rack 16 is contacted with the ratchet of the ratchet wheel to push the ratchet wheel to rotate in the counter-clockwise direction, during this proceed, the transmission element 13 slides to the right in the transmission rack 16, the third reset spring 15 is compressed; during the transmission rack 16 moving up, as the spring flapper 11-3 limits, the first and second reset springs 12 are compressed as well.

The ratchet wheel 9 rotates to drive the water diversion plate 4 to rotate synchronously, the water diversion hole 4-1 of the water diversion plate 4 changes its position to align with other inlet hole 2-2 or the combination to achieve the switch of the outlet function. The stop pawl 7 abuts against the ratchet wheel to prevent the ratchet wheel from rotating reversely.

Release the press button 22, under the action of the first and second reset springs 12 and the third reset spring 15, and the transmission rack 16 resets downwardly, the transmission element 13 resets to the left, and when the transmission rack 16 resets downwardly, the sliding block 17, the pendulum 19 and the press button 22 reset one by one.

The Second Embodiment

Referring to FIGS. 14-17, the driving mechanism of this embodiment comprises a press button 22', two wire clasps 25', a steel wire unit 27' and the driving rod 28'. As figured in FIG. 16, the wire clasp 25' comprises a fixing cover 25'-1 in the central, two sides of the fixing cover 25'-1 are disposed respectively with an extending portion 25'-2, each of which is disposed with a screw hole 25'-3, the lower surface of the fixing cover 25'-1 is disposed with a groove 25'-4 with section shape semi-circle. One of the wire clasps is fixed to the fixing seat 6', the other one is fixed to the reset rack 11.

Figure 17:
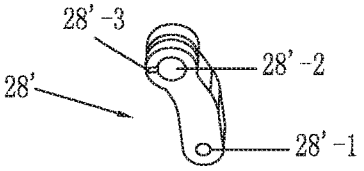
FIG. 17 illustrates a schematic diagram of the pull rod of the second embodiment.
Figure 18:
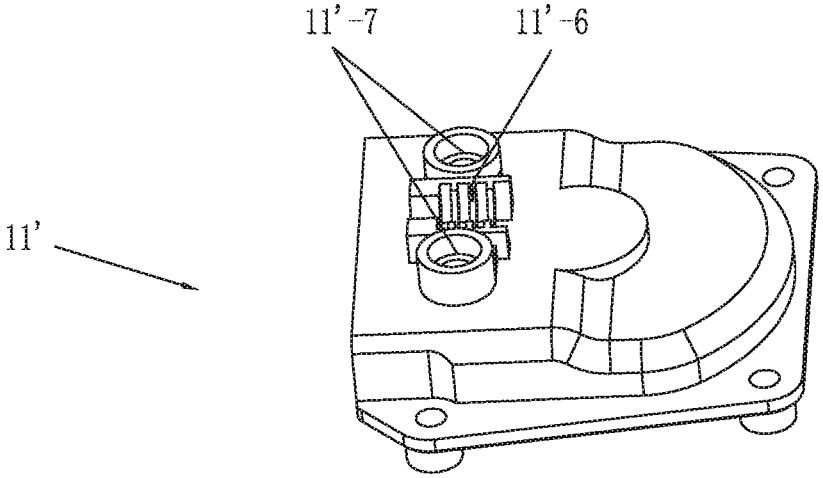
FIG. 18 illustrates a schematic diagram of the reset rack of the second embodiment.

As figured in FIG. 17, the pull rod 28' comprises a fixing end 28'-1 and a connecting end 28'-2, the fixing end 28'-1 is fixed to the pull rod fixing portion 6'-14 of the fixing seat 6' by the pull rod fixing shaft 29'. The connecting end 28'-2 is disposed with a still wire opening 28'-3.

Figure 15:
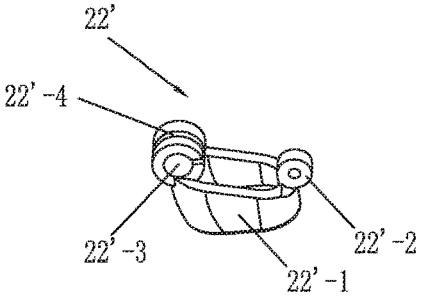
FIG. 15 illustrates a schematic diagram of the press button of the second embodiment.
Figure 16:
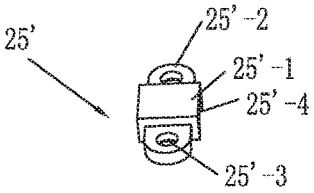
FIG. 16 illustrates a schematic diagram of the wire clasp of the second embodiment.

As figured in FIG. 15, the press button 22' comprises a button cap 22'-1, one end of the bottom of which is disposed with a pivot portion 22'-2, the other end (free end) is disposed with a connecting portion 22'-3, the connecting portion 22'-3 is disposed with a wire groove 22'-4.

Figure 14:
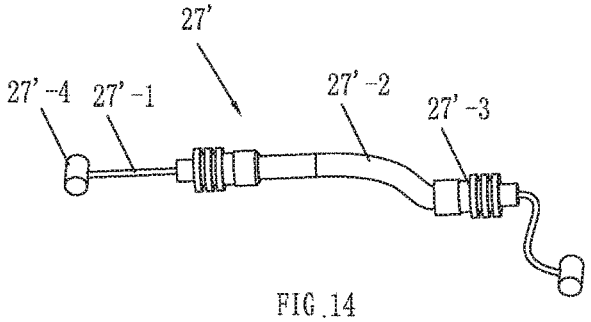
FIG. 14 illustrates a schematic diagram of the steel wire unit of the second embodiment.

As figured in FIG. 14, the steel wire unit comprises a steel wire 27'-1, the central section of the steel wire 27'-1 is disposed with a sleeve 27'-2, two ends of the sleeve are respectively disposed with a fixing portion 27'-3, one of the fixing portion 27'-3 is locked between the groove of the wire clasp of the fixing seat 6' and the steel wire fixing groove, the other fixing portion 27'-3 is locked in the steel wire fixing groove 11'-6 of the reset rack 11. Two ends of the steel wire 27'-1 are respectively disposed with a limit column 27'-4, one is locked to the rear side of the wire groove 22'-4 of the press button 22', the other one is locked to the connecting end 28'-2 of the pull rod.

Referring to FIG. 10, FIG. 11, FIG. 13A, FIG. 13B and FIG. 18, the waterway switch device further comprises a reset rack 11', which is generally square shaped, four corners respectively disposed with a screw fixing hole 11'-1 corresponding to the screw fixing hole 6-4 of the fixing seat 6, the bottom portion is disposed with an accommodating chamber 11'-2, the lower portion of the accommodating chamber is disposed with an opening 11'-5, the left and right sides of the center portion are respectively disposed with a spring flapper 11'-3, the lower portion of the spring flapper 11'-3 is disposed with a limit portion 11'-4, the transmission rack 16 enters from the opening 11'-5 and slides up and down along the limit portion 11'-4. The top surface of the reset rack 11' is disposed with two wire clasp fixing columns 11'-7 a steel wire fixing groove 11'-6 is disposed between the two wire clasp fixing columns.

Figure 12A:
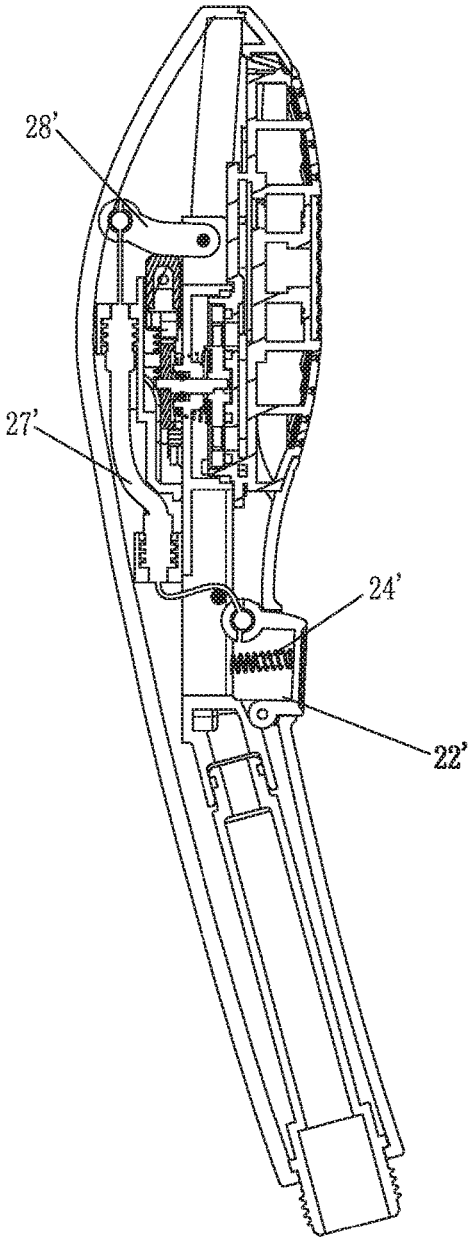
FIG. 12A illustrates a sectional diagram of the second embodiment from another view angle before the press.
Figure 12B:
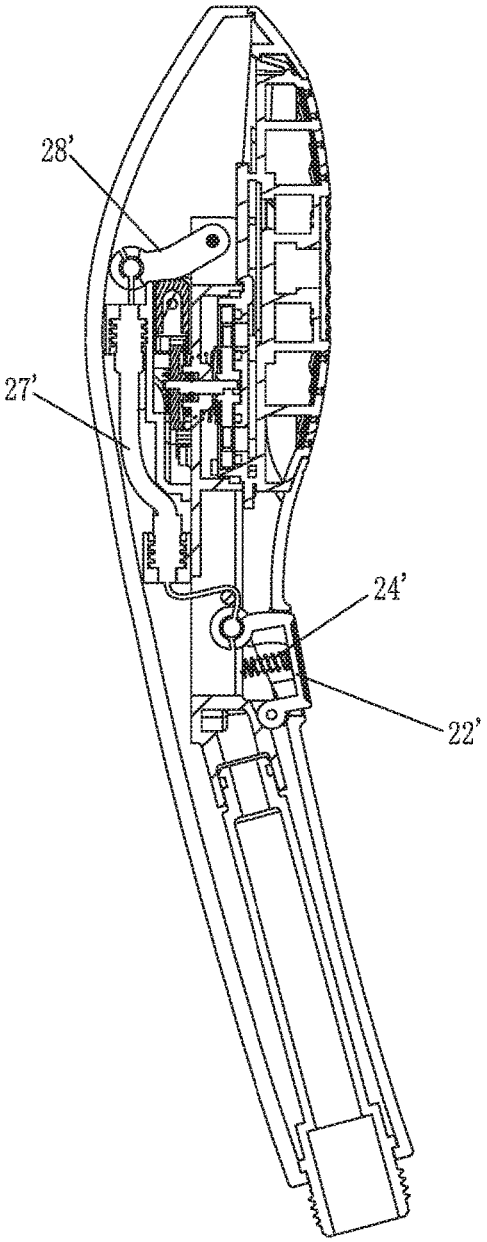
FIG. 12B illustrates a sectional diagram of the second embodiment from another view angle after the press.
Figure 13:
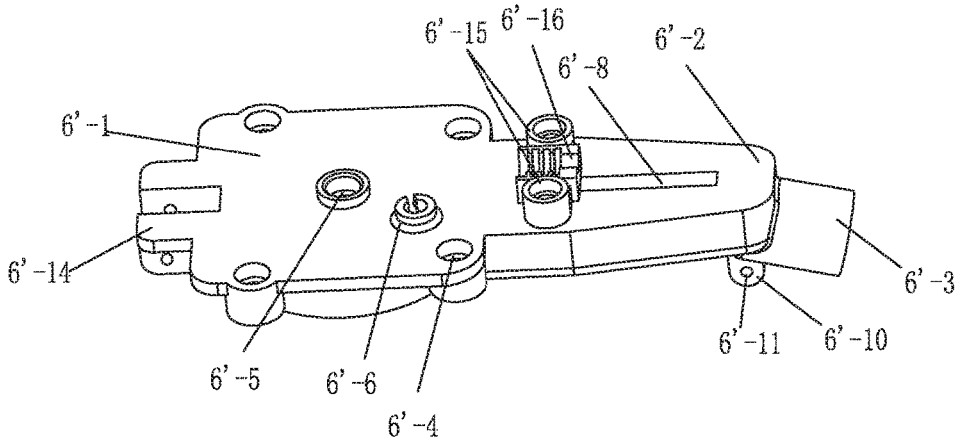
FIG. 13 illustrates a schematic diagram of the fixing seat of the second embodiment.

The present invention is used as described hereafter:

As figured in FIG. 12A and FIG. 12B, pressing the press button 22' to make the press button 22' rotate about the button fixing shaft 23' in the press button fixing shaft hole 6'-11, the free end of the button 22' rotates, one end of the steel wire unit 27' is pulled down; so that it drives the connecting section of the pull rod 28' at the other side of the steel wire unit 28' to move downwardly. As the fixing end of the pull rod 28' keeps still, the pull rod 28' drives the transmission rack 16 contacted with the pull rod 28' to move downwardly.

Figure 11A:
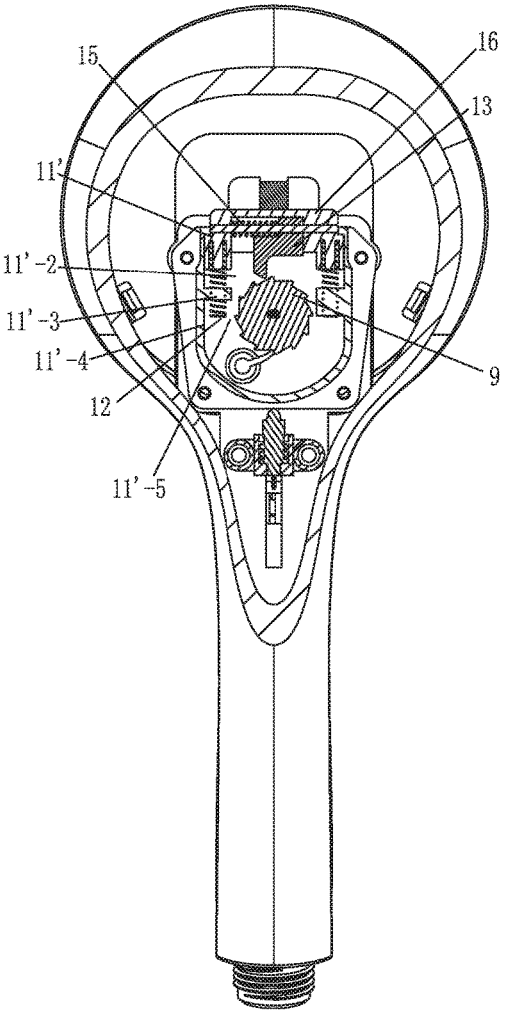
FIG. 11A illustrates a sectional diagram of the second embodiment before the switch.
Figure 11B:
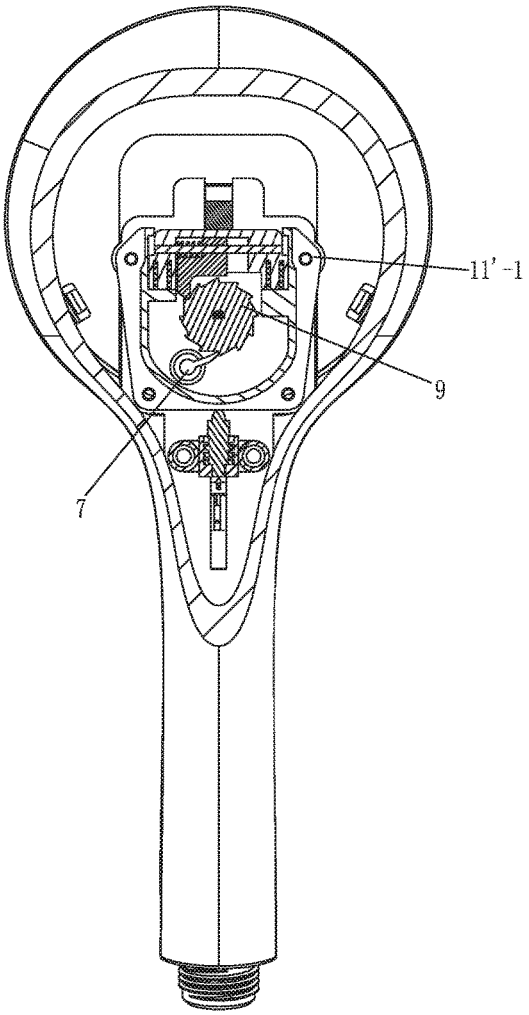
FIG. 11B illustrates a sectional diagram of the second embodiment after the switch.

As figured in FIG. 11A and FIG. 11B, the transmission portion 11-3 at the end of the transmission element 13 in the transmission rack 16 is contacted with the ratchet of the ratchet wheel 9, the transmission portion 13-3 drives the ratchet wheel to rotate in the counter-clockwise direction, during this proceed, the transmission element 13 slides to the left in the transmission rack 16, the reset spring 15 is compressed; during the transmission rack 16 moving down, as the spring flapper 11-3 limits, two reset springs 12 are compressed as well.

The ratchet wheel 9 rotates to drive the water diversion plate 4 to rotate synchronously, the water diversion hole 4 of the water diversion plate 4 changes its position to align with other inlet hole 2 or the combination to achieve the switch of the outlet function. The stop pawl 7 abuts against the ratchet wheel to prevent the ratchet wheel from rotating reversely.

As figured in FIG. 12A and FIG. 12B, release the press button 22', under the action of the reset springs 12, 15, and the transmission rack 16 resets upwardly, the transmission element 13 resets to the right, and when the transmission rack 16 resets upwardly, the steel wire unit 27', the pull rod 28' and the press button 22' reset one by one.

Above mentioned are detailed embodiments of the present invention, but the present invention is not limited, for example, the limit rack 11 can be integrated to the upper body 14 or the fixing rack, the receiving chamber of the transmission rack 16 can be a sliding groove, although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A switchable shower head, comprising:

(a) a waterway device that is connected to a water pipe and that provides at least two water flow outlet functions for the switchable shower head; and (b) a waterway switching device that is provided within a waterway of the waterway device and that comprises:

(i) a water diversion plate that is disposed in the waterway and that is rotatable to switch from one water flow outlet function of the at least two water flow outlet functions to another water flow outlet function of the at least two water flow outlet functions;

(ii) a fixing seat disposed above and in communication with the water diversion plate;

(iii) a ratchet wheel that is coaxially connected to and synchronously rotatable with the water diversion plate via the fixing seat and includes a ratchet;

(iv) a transmission element that abuts against the ratchet of the ratchet wheel to cause the ratchet wheel to rotate;

(v) a transmission rack that is disposed in the waterway switching device, that has the transmission element slidably assembled thereto so that the transmission element slides in a sliding direction, that is movable with respect to the ratchet wheel in a moving direction to close the ratchet wheel, and that is resettable by two or more elastic elements disposed in communication with the transmission rack; and (vi) a driving device that comprises a press button in communication with the fixing seat; and a driver mechanism provided between the press button and the transmission rack that comprises (a) two wire clasps, a steel wire unit, and a driving rod that communicate in that order or (b) a pendulum and a sliding block that communicate so that pressing the press button acts on the fixing seat to drive the driver mechanism to move the transmission rack to close the ratchet wheel, wherein an angle is formed between the sliding direction of the transmission element and the moving direction of the transmission rack that ranges from 30 to 150 degrees.

2. The switchable shower head according to claim 1, wherein the driver mechanism comprises the two wire clasps, the steel wire unit, and the driving rod.

3. The switchable shower head according to claim 1, wherein the angle between the moving direction of the transmission rack and the sliding direction of the transmission element is 90 degrees.

4. The switchable shower head according to claim 1, wherein the transmission rack has a central portion that is disposed with a sliding chamber having a side wall and a transmission element fixing shaft on which the transmission element is sleeved, wherein the two or more elastic elements disposed in communication with the transmission rack comprise a first reset spring and a second reset spring, and wherein a third reset spring is disposed between the transmission element and the side wall of a sliding cavity so that the transmission element compresses the third reset spring when sliding to abut against the ratchet wheel.

5. The switchable shower head according to claim 1, wherein the waterway switching device further comprises a reset rack that is fixed to the waterway switching device to correspond to the transmission rack, wherein a spring flapper is further configured, wherein the two or more elastic elements disposed in communication with the transmission rack comprise a first reset spring and a second reset spring having respective ends, and wherein the transmission rack has a left end and a right end that are respectively disposed with the first reset spring and the second reset spring, one end of the first reset spring and one end of the second reset spring being disposed on the transmission rack, and another end of the first reset spring and another end of the second reset spring being disposed on the spring flapper.

6. The switchable shower head according to claim 1, wherein the waterway device further comprises a cover plate having one side that is disposed with a plurality of inlet holes, and having another side that is disposed with a plurality of outlet holes, and wherein the at least two water flow outlet functions of the waterway device are formed by combining an inlet hole or a combination of inlet holes with a set of outlet holes so that when the water diversion plate rotates, the outlet holes of the water diversion plate correspond to the inlet hole or the combination of inlet holes of the cover plate.

7. The switchable shower head according to claim 6, wherein the cover plate has an upper portion and a fixing seat that is disposed at the upper portion and that comprises a main body; an extending section; and a rear section, wherein the extending section has a transition area and a bottom portion disposed with a pendulum fixing column and has defined therein an elongated through hole extending in a left-right direction from a left end thereof to a right end thereof, the left end of the elongated through hole being disposed with an elongated guide groove extending to the left, and wherein a button fixing column is disposed at the transition area of the extending section and the rear section of the fixing seat.

8. The switchable shower head according to claim 7, wherein the driver mechanism comprises the pendulum and the sliding block, the pendulum having one end that is pivoted to the pendulum fixing column at a bottom portion of the fixing seat and another end that is a free end that passes through the elongated through hole, and one side of the free end abuts against the side of the sliding block, and wherein the press button has one end that is fixed to the button fixing column at the bottom portion of the fixing seat, and another end that abuts against another side of the free end of the pendulum.

9. The switchable shower head according to claim 1, wherein the press button is disposed at the water pipe of the switchable shower head.

10. The switchable shower head according to claim 1, wherein the press button is disposed in the water pipe.

* * * * *